US006669040B2

(12) United States Patent
Higuchi

(10) Patent No.: US 6,669,040 B2
(45) Date of Patent: Dec. 30, 2003

(54) CONTAINER CAPABLE OF MAINTAINING ITS COMPRESSED STATE IN A LONGITUDINAL DIRECTION AND COMPRESSION METHOD THEREOF

(75) Inventor: Mitsuo Higuchi, Yamanashi (JP)

(73) Assignee: Gohsho Company, Limited, Yamanashi (JP)

( * ) Notice: Subject to any disclaimer, the term of this patent is extended or adjusted under 35 U.S.C. 154(b) by 0 days.

(21) Appl. No.: 10/092,566

(22) Filed: Mar. 8, 2002

(65) Prior Publication Data

US 2003/0121881 A1 Jul. 3, 2003

(30) Foreign Application Priority Data

Dec. 27, 2001 (JP) ..... 2001-397668

(51) Int. Cl.[7] ..... B65D 1/44

(52) U.S. Cl. ..... 215/381; 215/382; 215/400; 215/900; 220/666

(58) Field of Search ..... 215/381, 382, 215/900, 400; 220/666, 672, 907; 222/215

(56) References Cited

U.S. PATENT DOCUMENTS 3,083,877 A * 4/1963 Gash ..... 215/900 X
3,301,293 A * 1/1967 Santelli ..... 220/666
3,390,821 A * 7/1968 Mullan ..... 215/900 X
4,492,313 A * 1/1985 Touzani ..... 215/900 X
4,873,100 A * 10/1989 Dirksing et al. ..... 215/382 X
5,080,149 A * 1/1992 Peoples ..... 215/900 X
5,224,613 A * 7/1993 Robbins, III ..... 215/900 X
5,384,138 A * 1/1995 Robbins, III et al. ... 215/900 X
5,573,129 A * 11/1996 Nagata et al. ..... 215/900 X
5,584,413 A * 12/1996 Jung ..... 215/382 X
6,105,815 A * 8/2000 Mazda ..... 220/666

FOREIGN PATENT DOCUMENTS

FR 2607109 * 5/1988 ..... 215/900
JP 3289447 * 12/1991 ..... 220/672

* cited by examiner

*Primary Examiner*—Sue A. Weaver

(57) ABSTRACT

A container body of which length in the longitudinal direction or a part thereof is formed into horizontal accordion shape except the tap portion, wherein a force in one direction acts on a piece of folds constituting the accordion shape and/or a part of inner periphery, while a force in the opposite direction acts on the outer periphery thereof, when a force from a substantially right-angle direction thereof is applied to the accordion-shaped portion of said container body, thereby a compressed state in a longitudinal direction is maintained.

9 Claims, 8 Drawing Sheets

CONTAINER CAPABLE OF MAINTAINING ITS COMPRESSED STATE IN A LONGITUDINAL DIRECTION AND COMPRESSION METHOD THEREOF

BACKGROUND OF THE INVENTION

1. Field of the Invention

The present invention relates to a container for juice or mineral water produced by a blow molding method or the like, in particular an improvement of a container capable of being compressed in a longitudinal direction (being reduced in volume) after drinking up its content.

2. Description of the Related Art

Sales of synthetic resin containers have been increasing considerably in recent years. However, when juice or mineral water in the body of a container is drunk and the container is thrown away, the shape of the container body remains the same, and in case of throwing such a container away in a trash can, the trash can looks as if air is dumped in it. The trash can will be undesirably fulfilled soon, and in the end, such containers will be thrown away out of the trash can, which might deteriorate our life environment, and in addition, the cost of collecting drained containers and the labor cost for cleaning are problematic in public services.

Also, this kind of synthetic resin container can be manufactured by a simple means such as blow molding, but on the contrary, the strength of the container could not yet be said satisfactory for transportation by vehicle which is accompanied by violent vibration or for stacked display in stores.

Furthermore, when containers are transported from a container manufacturer to a bottler of juice or mineral water, the containers take up much space, which results in increasing the cost of transportation.

SUMMARY OF THE INVENTION

It is an object of the present invention to make it possible to reduce extremely the volume of a container body remarkably, when juice or mineral water in the container body is drained and the container body is thrown away, and to increase the number of the container to be thrown in a trash can.

At the same time, that makes it possible to transport a large number of empty container bodies at a time, so it is also an object of the present invention to make it possible to reduce the collection cost and the labor cost thereof.

It is also an object of the present invention to increase a quantity of container per transportation from a container manufacturer to a bottler of juice or mineral water.

Furthermore, the object of the present invention is to make it possible to maintain a compressed shape of a container body without providing the container body with a restoring force after the volume of the container body is reduced.

It should be appreciated that the entire shape of the container body of the present invention is selected from a circular cylinder including an ellipse, a rectangular column, a circular cone and a pyramid, and the horizontal cross sectional shape of the container is selected from a circle including an ellipse and a rectangle.

Another object of the present invention is to make it possible to enlarge the surface area of the container, compared to a conventional one, on which a label showing contents, a trademark or the like is fixed or on which its contents or a trademark is directly printed.

Also, it should be appreciated that the container body of the present invention has a good appearance, can be prevented from failing when being used, can prevent its contents from spilling out, and can maintain a compressed state in its longitudinal direction, and a compression method thereof is provided.

The present invention is characterized by that a force in one direction acts on a piece of the plate members connected by folds constituting an accordion-shaped portion of a container body and/or a part of its inner periphery, while a force in the opposite direction acts on its outer periphery, when a force from the substantially right-angle direction thereof is applied to the accordion shape, thereby a compressed state of the container body in a longitudinal direction is maintained.

Furthermore, the present invention is characterized by that the accordion-shaped portion of the container body has one diameter thereof smaller than the other diameter.

Still further, the present invention is characterized by that the accordion-shaped portion of the container body has one diameter smaller than the other diameter, and equal to a lower diameter, by increasing gradually as it approaches the other.

Still further, the present invention is characterized by a compression method of a container capable of maintaining a compressed state in a longitudinal direction wherein a force in one direction acts on a piece of folds constituting the accordion shape and/or a part of inner periphery, while a force in the opposite direction acts on the outer periphery thereof, when a force from a substantially right-angle direction thereof is applied to the accordion-shaped portion of said container body, thereby a compressed state in a longitudinal direction is maintained.

Still further, the present invention is characterized by a compression method of a container capable of maintaining a compressed state in a longitudinal direction wherein a force in one direction acts on a piece of the plate members connected by folds constituting the accordion shape and/or a part of inner periphery, while a force in the opposite direction acts on the outer periphery thereof, when a force from a substantially right-angle direction thereof is applied to the accordion-shaped portion of said container body, thereby a compressed state in a longitudinal direction is maintained.

Still further, the present invention is characterized by that the horizontal cross sectional shape of the container body is selected from a circle including an ellipse, and a rectangle.

Still further, the present invention is characterized by the one comprising a container body provided with a tap portion projecting upward from the middle portion at the top end, and horizontal accordion shape formed on the inner and outer wall of the container body, over the whole length in the longitudinal (height) direction or a part thereof, except the tap portion, wherein the accordion-shaped portion of the body has an upper diameter thereof smaller than the lower diameter, and increasing gradually as it goes downward; a force acts downwards in the inner diameter direction of the plate members of accordion shape of the upper part, and downwards in the outer diameter direction, when the force from a substantially right-angle direction is applied to the accordion-shaped portion of said container body; and the force acts upwards in the inner diameter direction of the plate members of accordion shape of the lower part, and upwards and downwards in the outer diameter direction, for maintaining a accordion shape where the length (height) of said container body is compressed.

It should be appreciated that for the container body of the present invention, in case of carrying or holding it after having drained a part of, for example, juice, the container body can be compressed by the amount of drained quantity thereof; therefore, the present invention is also characterized by that its volume to be carried or held can be reduced as much.

DESCRIPTION OF CHARACTERS

Figure 1:
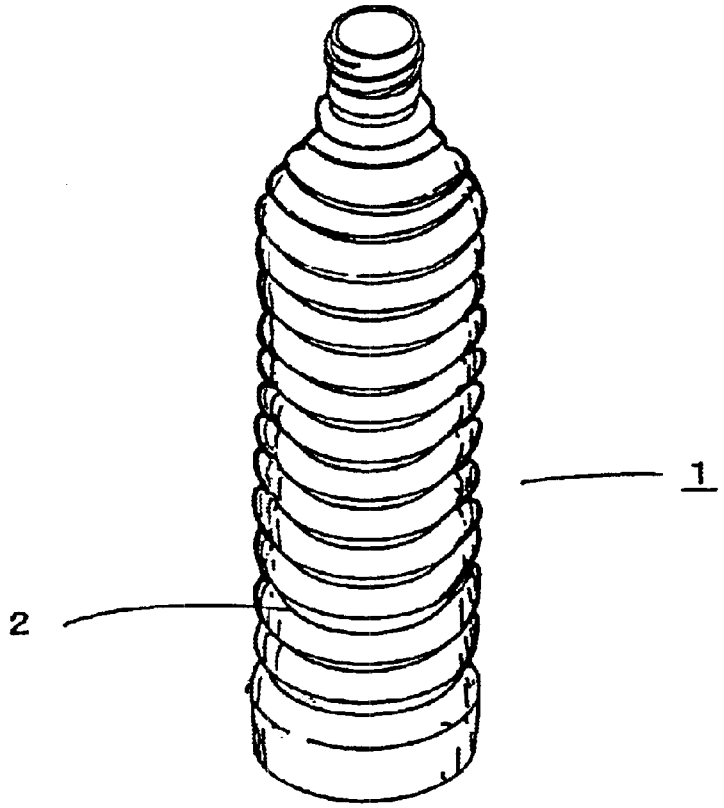
FIG. 1 is a perspective view of a container body which is one embodiment of the present invention.

1 Body of container
2 Accordion-shaped portion
3 Tap portion
4 Curved portion
5 Label
6 Plate member of the first stage
7 Plate member of the second stage
8 Plate member of the third stage
9 Plate member of the fourth stage
d Outer diameter
d1 Diameter of the first stage
d2 Diameter of the second stage
d3 Diameter of the third stage
f Pushing down force
f1 Inside periphery of plate member (6)
f2 Outside periphery of plate member (6)

DETAILED DESCRIPTION OF THE PRESENT INVENTION

An embodiment of the present invention shown in the attached drawings will be described.

(1) is a container body, and the outer and inner peripheries in the height (length) direction thereof have an accordion shape (2). There, though the illustrated container has an accordion shape all over the height direction, the middle or the end portion thereof can be made flat, to indicate the commercial mark of product contents thereon.

Figure 2:
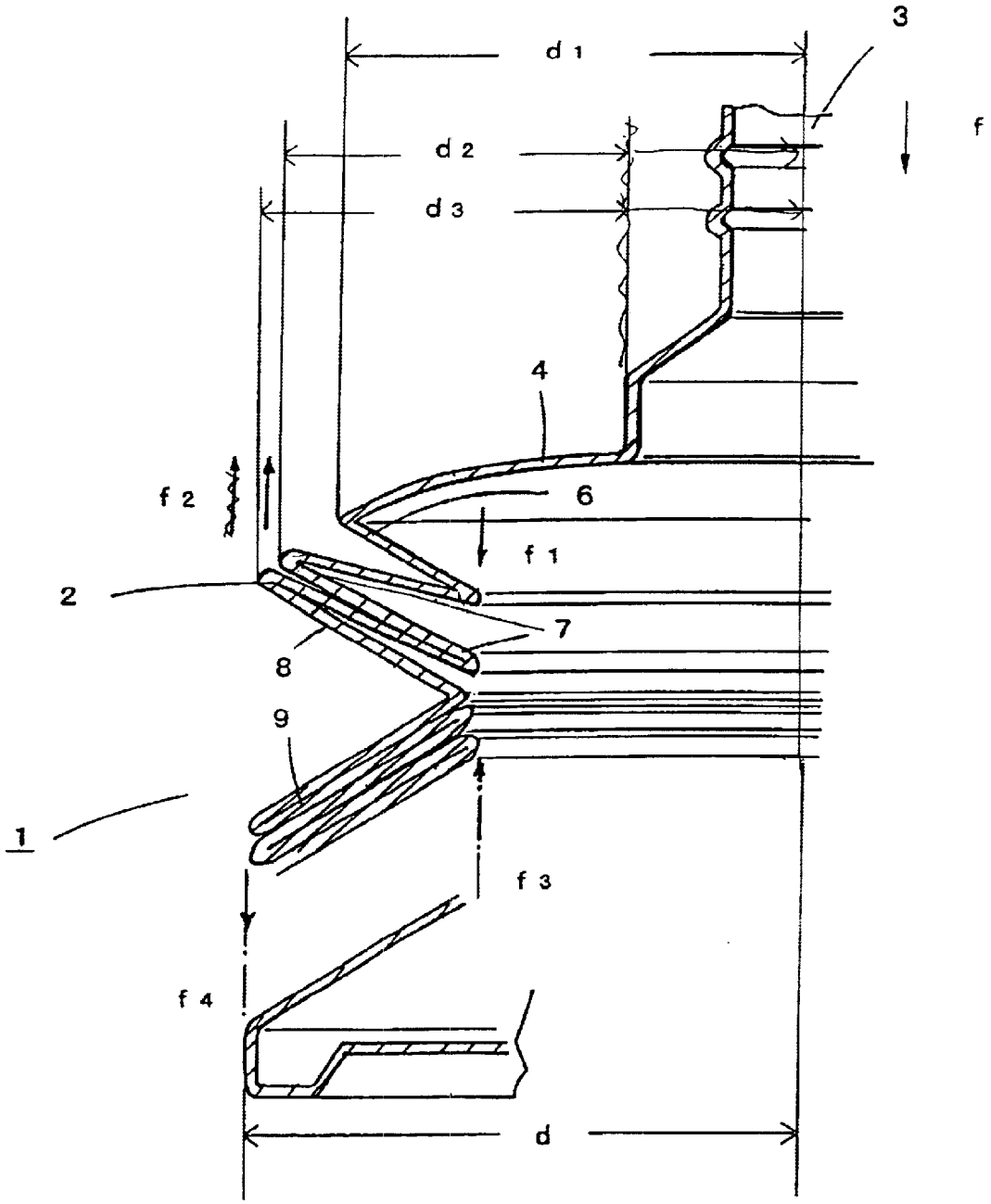
FIG. 2 is a partially cutout longitudinal sectional view of a state where the container body is collapsed.

FIG. 2 shows a state where mineral water sealed in the aforementioned container body (1) is drained up and the same is collapsed in the height (length) direction from one or both sides thereof. Namely, the container body (1) of the present invention has an excellent configuration and deploys an excellent function.

Also, in FIG. 2, (3) is a tap portion of the container body (1), a directly lower part thereof has a curved portion shape (4), and the diameter of the second stage (namely, the uppermost stage of the aforementioned accordion-shaped portion (2)) (d1) is made smaller than the outer diameter (d) of the container body (1). Then, the diameter (d2) of the accordion shape (2) of the second stage in respect to the accordion shape of the first stage, is larger than the aforementioned diameter (d1) of the first stage and smaller that the outer diameter (d) of the container body (1).

Further, the side view is stepped in order to form a diameter (d3) of the third stage larger than the aforementioned outer diameter (d2) of the second stage; however, the number of stages is, of course, not limited to three (3), but a plurality of stages may be adopted.

Figure 3:
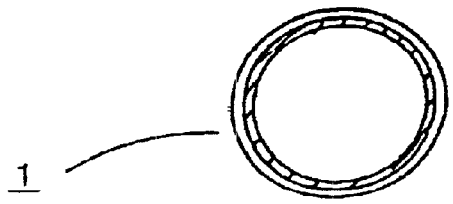
FIG. 3 is a circular cylinder cross sectional view of another embodiment.
Figure 4:
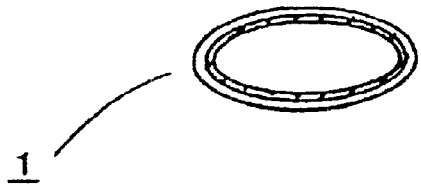
FIG. 4 is an ellipse cross sectional view of another embodiment.
Figure 5:
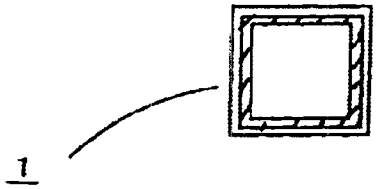
FIG. 5 is a rectangle cross sectional view of another embodiment.
Figure 6:
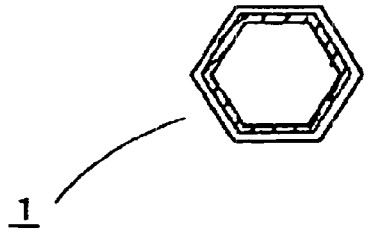
FIG. 6 is a polygon cross sectional view of another embodiment.
Figure 7:
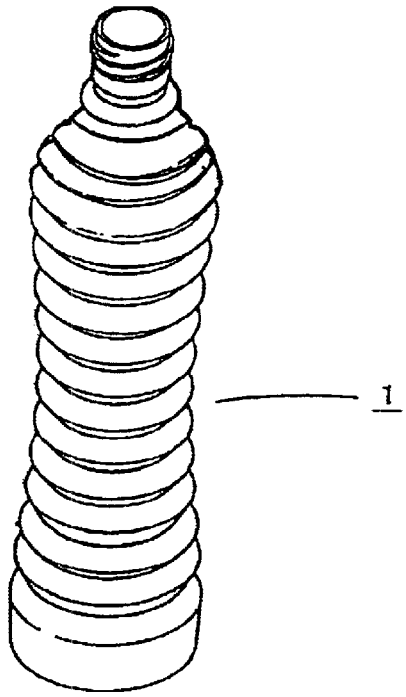
FIG. 7 is an hourglass shaped drum perspective view of another embodiment.

It should be appreciated that the cross sectional shape of the container body (1) is not limited to a circle as in FIG. 3, but it may be elliptical as in FIG. 4, or a square as in FIG. 5, or a polygon in FIG. 6. Also, the height (length) direction shape may be, in addition to a circular cylinder as in FIG. 1, an hourglass shaped drum, or a barrel-shaped drum though not illustrated herein.

Figure 8:
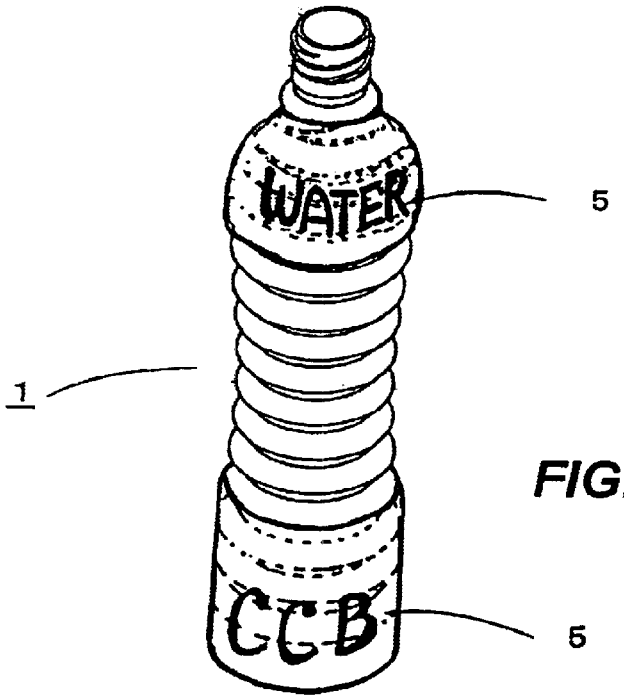
FIG. 8 is a perspective view of the same to which labels are fixed.
Figure 9:
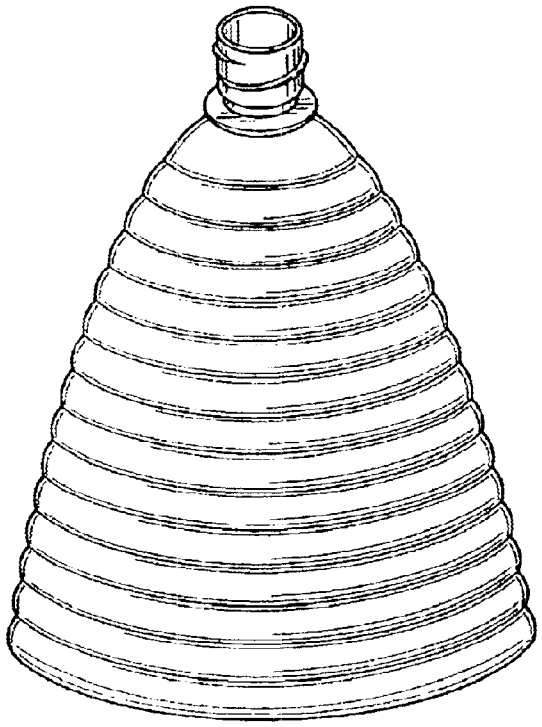
FIG. 9 is a perspective view of a circular cone-shaped container according to the invention.
Figure 10:
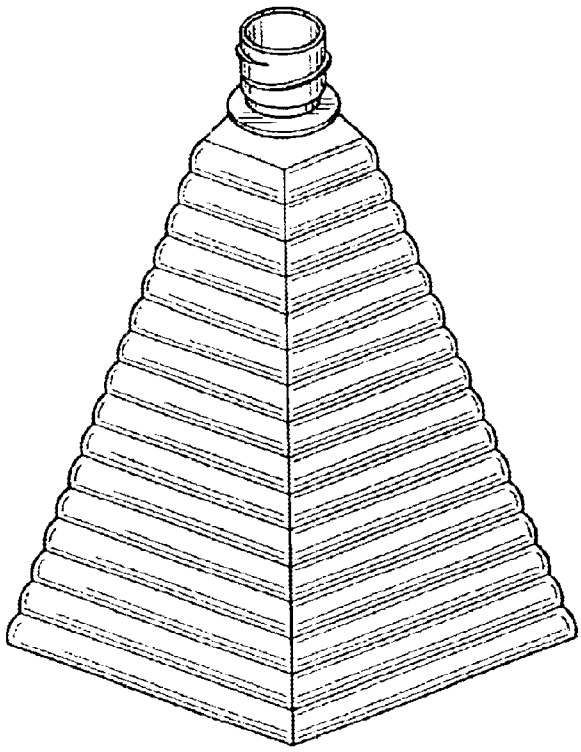
FIG. 10 is a perspective view of a pyramid-shaped container according to the invention.
Figure 11A:
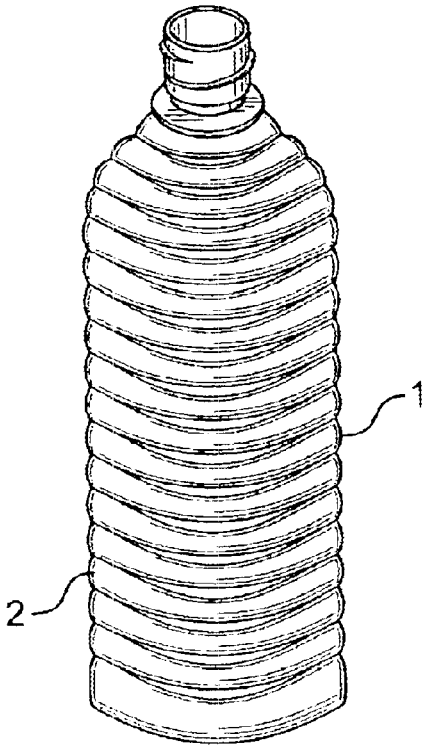
FIG. 11A is a perspective view of a container shaped as an ellipse cylinder according to the invention.
Figure 11B:
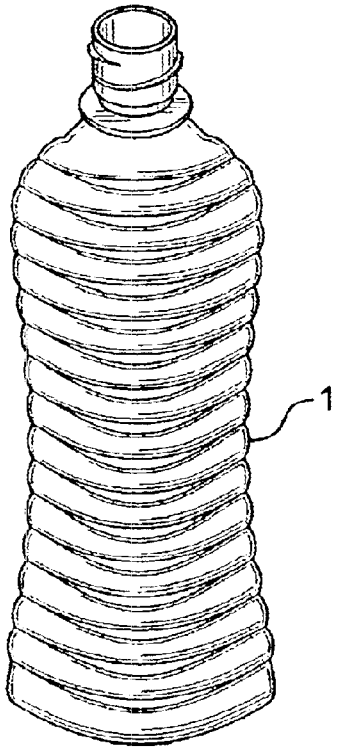
FIG. 11B a perspective view of a container shaped as a hourglass shaped ellipse cylinder according to the invention.
Figure 12A:
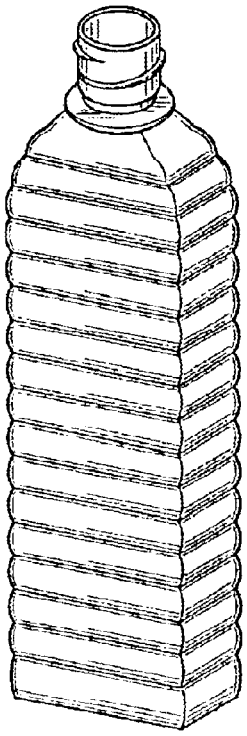
FIG. 12A is a perspective view of a container shaped as a rectangular column according to the invention.
Figure 12B:
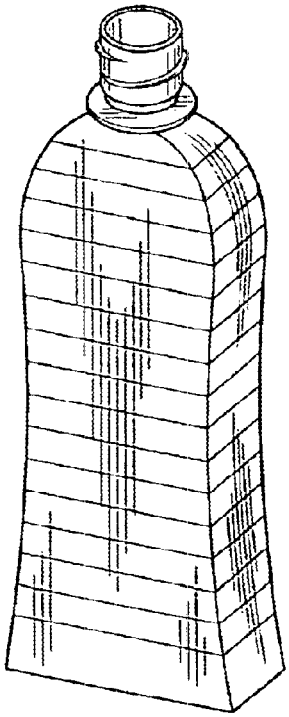
FIG. 12B a perspective view of a container shaped as a hourglass shaped rectangular column according to the invention.
Figure 13A:
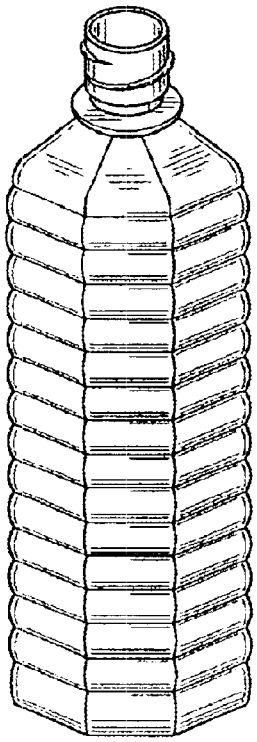
FIG. 13A is a perspective view of a container shaped as a polygon column according to the invention.
Figure 13B:
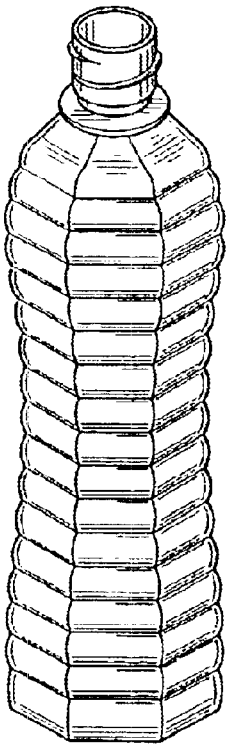
FIG. 13B a perspective view of a container shaped as a hourglass shaped polygon column according to the invention.

Moreover, in this FIG. 8, (5) is a label fixed around one or both of the upper part or lower part of the container body (1), made of a thin synthetic resin film and showing a trademark for the product or a specification of contents and, in this case, it should be collapsible together with the container body (1) without resistance when the contents of the container body (1) is drained up and the container body (1) is collapsed.

Thus, the container body (1) is manufactured by a blow molding means and is transported to a bottling factory of, for example, mineral water. In this case, a large quantity of container bodies (1) can be transported at a time by reducing the height (length) of the container body (1) by a certain means as shown in FIG. 2, and be expanded again in the bottling factory of mineral water.

However, ordinarily, in most of the bottling operations of mineral water or juice, material flows in the form of pipe through an extruder from a powder resin material, the container body (1) is molded by an automatic molder called a rotary machine, filled with mineral water automatically, capped and labeled in a series of continuous operations.

Now, suppose all juice in the container body (1) is drained up. Here, the tap portion (3) is pushed down by a relatively strong force (f). This force (f) pushes down the periphery inside a plate member (6) of the first stage of the accordion shape through the inside of a curved portion (4). As the result, an outside periphery of the plate member (6) is raised upward. Thus, several stages (three stages for the illustrated example) of the accordion shape (2) performs such a function; however, in case of this embodiment, the upper part of the accordion-shaped portion (2) forms a curved portion (4), the diameter (d1) of the plate member (6) of the first stage is smaller than a plate member (7) of the second stage, the outer diameter (d3) of a fold plate member (8) of the third stage is larger the outer diameter (d2) of this fold plate member (7) of the second stage, and the outer diameter (d3) is equal to the outer diameter (d) of the container body (1), therefore, the force of the aforementioned tap portion (3) is transformed into a force pushing up the inside and pushing down the outside, at a plate member (9) of the fourth stage in the drawing.

As the result, the accordion-shaped portion (2) of the container body (1) is composed of many ">"-shaped plate assemblies each including two plate members connected by a fold therebetween below the curved portion (4), i.e., the stages under it. A force (f1) pushing down the inside peripheries of the plate members (6) to (8) is balanced with a force (B) pushing up the inside peripheries of the plate member (9) and the below stages, and at the same time, a force (f4) pushing down the outside peripheries of the plate member (9) and the below stages is balanced with a force (f2) pushing up the outside peripheries of the folds plate members (6) to (8) to prevent the container body (1) from restoring to its original shape such that the container body (1) maintains this collapsed state. In other words, the container capable of maintaining a compressed state in a longitudinal direction according to includes a container body of which whole length in a longitudinal direction or a part thereof is formed into an accordion with folds except a tap portion. The accordion includes: a convex portion having an inside periphery connected with the tap portion and an outside periphery; a upper group of plate members increasing gradually in length downwards as measured on a cross-sectional plane taken along a longitudinal axis of the container, each upper-group plate member, except a last upper-group plate member, having an inside periphery connected with an inside periphery of an upper-group plate member by a fold therebetween, and each upper-group plate member, except a first upper-group plate member, having an outside periphery connected with an outside periphery of an upper-group plate member by a fold therebetween, the first upper-group plate member having an outside periphery connected with the outside periphery of the convex portion; and a lower group of plate members maintaining a same length as measured on the cross-sectional plane, each lower-group plate member, except a first lower-group plate member, having an inside periphery connected with an inside periphery of an lower-group plate member by a fold therebetween, and each lower-group plate member, except a last lower-group plate member, having an outside periphery connected with an outside periphery of an lower-group plate member by a fold therebetween, the first lower-group plate member having an inside periphery connected with an inside periphery of the last upper-group plate member, each lower-group plate member is longer than each upper-group plate member. The folds are so formed that a force along the longitudinal direction applied to the tap portion of the container body reaches a balance between a downward force on inside peripheries of the convex portion and the upper-group plate members and a upward force on inside peripheries of the lower-group plate members such that the inside peripheries of the convex portion and the upper-group plate members are collapsed downward and the inside peripheries of the lower-group plate members are raised upward, and a balance between a upward force on outside peripheries of the upper-group plate members and a downward force on outside peripheries of the lower-group plate members such that the outside peripheries of the convex portion and the upper-group plate members are raised upward and the outside peripheries of the lower-group plate members are collapsed downward. The container according to claim 1, wherein the inside peripheries of the upper-group plate members (e.g., 6–8), and the lower-group plate members (e.g., 9) raised or collapsed upon one another to be aligned in the longitudinal direction.

As the result, in repeated experiments, the height (volume) of container body (1) was compressed to ⅓ to ¼ or lesser, and the space necessary in a trash can or the like for dumping it can be reduced by far.

A main effect of the present invention mentioned above is that the volume of the container body was made able to be reduced by far, and the number thereof to be contained in a trash can or other was increased by far.

In addition, as such a compressed container body can be transported in quantity at the same time, the collection cost thereof, and the labor cost for cleaning and collection could be reduced considerably.

The container body of the present invention has a good looking external shape, arouses a strong interest of the user, the accordion shape of the container body becomes a friction stop, preventing the container body from slipping and falling during the used, and the contents flow overflowing before occurrence.

Besides, even the shape of the container body collapsed according to the present invention looks good in respect of design and can be used as outer container as it is.

What is claimed is:

1. A container capable of maintaining a compressed state in a longitudinal direction comprising a container body of which whole length in a longitudinal direction or a part thereof is formed into an accordion with folds except a tap portion, said accordion including:

a convex portion having an inside periphery connected with the tap portion and an outside periphery;

a upper group of plate members increasing gradually in length downwards as measured on a cross-sectional plane taken along a longitudinal axis of the container, each upper-group plate member, except a last upper-group plate member having an inside periphery connected with an inside periphery of an upper-group plate member by a fold therebetween, and each upper-group plate member, except a first upper-group plate member, having an outside periphery connected with an outside periphery of an upper-group plate member by a fold therebetween, the first upper-group plate member having an outside periphery connected with the outside periphery of the convex portion; and a lower group of plate members maintaining a same length as measured on the cross-sectional plane, each lower-group plate member, except a first lower-group plate member, having an inside periphery connected with an inside periphery of an lower-group plate member by a fold therebetween, and each lower-group plate member, except a last lower-group plate member, having an outside periphery connected with an outside periphery of an lower-group plate member by a fold therebetween, the first lower-group plate member having an inside periphery connected with an inside periphery of the last upper-group plate member, each lower-group plate member is longer than each upper-group plate member, and said folds are so formed that a force along the longitudinal direction applied to the tap portion of said container body reaches a balance between a downward force on inside peripheries of the convex portion and the upper-group plate members and a upward force on inside peripheries of the lower-group plate members such that the inside peripheries of the convex portion and the upper-group plate members are collapsed downward and the inside peripheries of the lower-group plate members are raised upward, and a balance between a upward force on outside peripheries of the upper-group plate members and a downward force on outside peripheries of the lower-group plate members such that the outside peripheries of the convex portion and the upper-group plate members are raised upward and the outside peripheries of the lower-group plate members are collapsed downward.

2. The container according to claim 1, wherein the container body is selected from a circular cylinder, an ellipse cylinder, a rectangular column, a polygon column, a circular cone, and a pyramid.

3. The container according to claim 1, wherein a horizontal cross sectional shape of the container body is selected from circular, elliptical, square, rectangular, and polygonal.

4. The container according to claim 1, wherein a label of guidance or commercial mark of contents of the container is put around the outside peripheries of some of the plate members.

5. The container according to claim 1, wherein the inside peripheries of the upper-group plate members, and the lower-group plate members raised or collapsed upon one another to be aligned in the longitudinal direction.

6. A container capable of maintaining a compressed state in a longitudinal direction, comprising:

a container body provided with a tap portion projecting upward, and an accordion with plate members connected by folds formed on the whole or a part of a wall of the container body in a longitudinal direction except the tap portion, said plate members gradually increasing, then decreasing, then increasing again in length downwards, as measured on a respective cross-sectional plane taken along a longitudinal axis of the container so as to form a upper curved portion connection with a lower hourglass shaped body.

7. The container according to claim 6, wherein a horizontal cross sectional shape of the container body is selected from circular, elliptical, square, rectangular, and polygonal.

8. The container according to claim 6, wherein a label of guidance or commercial mark of contents of the container is put around the outside peripheries of some of the plate members.

9. A compression method for compressing a container capable of maintaining a compressed state in a longitudinal direction comprising:

providing a container body of which whole length in the longitudinal direction or a part thereof is formed into horizontal accordion with folds except the tap portion, said accordion including:

a convex portion having an inside periphery connected with the tap portion and an outside periphery;

a upper group of plate members increasing gradually in length downwards as measured on a cross-sectional plane taken along a longitudinal axis of the container, each upper-group plate member, except a last upper-group plate member, having an inside periphery connected with an inside periphery of an upper-group plate member by a fold therebetween, and each upper-group plate member, except a first upper-group plate member, having an outside periphery connected with an outside periphery of an upper-group plate member by a fold therebetween, the first upper-group plate member having an outside periphery connected with the outside periphery of the convex portion; and a lower group of plate members maintaining a same length as measured on the cross-sectional plane, each lower-group plate member, except a first lower-group plate member, having an inside periphery connected with an inside periphery of an lower-group plate member by a fold therebetween, and each lower-group plate member, except a last lower-group plate member, having an outside periphery connected with an outside periphery of an lower-group elate member by a fold therebetween, the first lower-group plate member having an inside periphery connected with an inside periphery of the last upper-group plate member, each lower-group plate member is longer than each upper-group plate member; and applying a force along the longitudinal direction to the tap portion of said container body so as to reach a balance between a downward force on inside peripheries of the convex portion and the upper-group plate members and a upward force on inside peripheries of the lower-group plate members such that the inside peripheries of the convex portion and the upper-group plate members are collapsed downward and the inside peripheries of the lower-group plate members are raised upward, and a balance between a upward force on outside peripheries of the upper-group plate members and a downward force on outside peripheries of the lower-group plate members such that the outside peripheries of the convex portion and the upper-group plate members are raised upward and the outside peripheries of the lower-group plate members are collapsed downward.

* * * * *